United States Patent [19]

Babbi

[11] Patent Number: 4,666,357

[45] Date of Patent: May 19, 1987

[54] SHIP TRANSPORT SYSTEM

[75] Inventor: Harvey Babbi, Goliad, Tex.

[73] Assignee: VMW Industries, Inc., Victoria, Tex.

[21] Appl. No.: 724,025

[22] Filed: Apr. 17, 1985

[51] Int. Cl.[4] ..... B66D 1/50

[52] U.S. Cl. ..... 414/138; 212/191; 212/230; 254/277; 254/900; 254/902

[58] Field of Search ..... 414/137, 138, 140, 542; 212/190, 191, 230, 267, 268; 254/273, 275, 277, 900, 902

[56] References Cited

U.S. PATENT DOCUMENTS

| | | | |
|---|---|---|---|
| 2,946,466 | 7/1960 | Weiner . | |
| 3,045,381 | 7/1962 | Martin | 242/84.1 A X |
| 3,189,194 | 6/1965 | Fox . | |
| 3,309,065 | 3/1967 | Prud'homme | 414/138 X |
| 3,341,034 | 9/1967 | Blasen . | |
| 3,462,786 | 8/1969 | Olsson . | |
| 3,512,281 | 5/1977 | Hadjidakis . | |
| 3,596,070 | 7/1971 | McCool . | |
| 3,624,783 | 11/1971 | Chang | 254/900 X |
| 3,662,991 | 5/1972 | Lazika | 414/137 |
| 3,778,855 | 12/1973 | Kariagin et al. | 212/267 X |
| 4,021,019 | 5/1977 | Sanders | 414/137 X |
| 4,111,313 | 9/1978 | Reiher et al. | 414/140 |
| 4,118,012 | 10/1978 | Kerr | 414/138 X |
| 4,136,391 | 1/1979 | Eterno | 364/463 X |
| 4,147,330 | 4/1979 | Eik | 414/137 X |
| 4,155,538 | 5/1979 | Claassen | 254/277 |
| 4,179,233 | 12/1979 | Bromell | 254/277 X |
| 4,304,337 | 12/1981 | Dummer | 212/191 |
| 4,349,179 | 9/1982 | Barber | 254/270 |
| 4,354,608 | 11/1982 | Wudtke | 414/137 X |
| 4,396,333 | 8/1983 | Nelson | 414/138 |
| 4,448,396 | 5/1984 | Delago | 414/138 X |
| 4,547,857 | 10/1985 | Alexander | 414/138 X |

*Primary Examiner*—Leslie J. Paperner

*Attorney, Agent, or Firm*—Jerry W. Mills; Gregory M. Howison

[57] ABSTRACT

A transport system (10) for transporting a litter carrier (40) from one location onboard a first ship to a second location onboard another ship includes a retractable boom (12) having a stationary member (16) and a telescoping member (18) slidably engaged therein. Boom (12) also includes a hoist unit (28) which is operatively connected through a hoist cable (34) to carrier (40) to cause movement thereof. Carrier (40) includes acoustic rangefinders (50) and contact detectors (52) which are electrically coupled to a control circuit (60) located onboard one of the vessels through internal electrical conductors in hoist cable (34). Rangefinders (50) generate signals indicative of the distance between carrier (40) and a selected one of the ships. Contact detectors (52) provide signals which indicate whether carrier (40) is in transit or has landed onto a ship. Control circuit (60) is operable to receive signals from acoustic rangefinders (50) and contact detectors (52) to compensate the operation of hoist (28) and carrier (40) for the relative motion between the two ships, thereby effecting a smooth transfer of the carrier between the ships.

27 Claims, 3 Drawing Figures

SHIP TRANSPORT SYSTEM

FIELD OF THE INVENTION

The present invention relates generally to transport systems and more specifically to a transport system for transferring personnel and cargo between ships.

BACKGROUND OF THE INVENTION

Transferring personnel and cargo from ship to ship or ship to shore has always been a difficult procedure because of the inherent motion of the ocean. The continuous motion of the water causes complex movements between the ships, or between the ship and shore, and thus creates problems when it is desired to transfer fragile cargo, such as wounded personnel, from a ship. Safe transfer of personnel between ships is particularly important for hospital ships where injured individuals must be transferred from a transport ship to a hospital ship in high seas.

Prior litter transport systems for ships have generally comprised a boom with a winch line connected to a litter carrier. Smooth take-off and landing for those prior systems has been extremely difficult to achieve even with skilled litter transport operators. Unless the litter carrier is lifted at substantially the peak of the upward movement of the vessel, there is a risk that after lift-off, the vessel will move upwardly and crash into the bottom of the litter. The same problem occurs in attempting to place the litter on the deck of the second receiving vessel, since a sudden upward movement of the vessel may cause a jarring impact which may damage the litter carrier or the patients.

SUMMARY OF THE INVENTION

The present invention described and disclosed herein comprises an improved ship personnel and cargo handling system which obviates the disadvantages of prior art devices by automatically adjusting the movement of the litter carrier to compensate for the relative motion between the litter carrier and the unloading and loading vessels.

More specifically, the present invention comprises a litter handling device including a hydraulically controlled hoist connected to a litter carrier. The litter carrier includes acoustic rangefinder devices and contact detectors mounted on the bottom of the carrier at each of its four corners. The rangefinder devices and contact detectors are electrically connected to a control circuit onboard the hospital vessel through internal conductors located in the hoist cable. The system also includes a retractable boom and a motion compensating shock absorber operatively coupled to the boom. The control circuit receives signals from the various sensors and is responsive thereto to vary the relative motion of the litter carrier with respect to the unloading and loading vessels. The system thus ensures a relatively smooth transfer of one or more litters to and from the hospital ship.

BRIEF DESCRIPTION OF THE DRAWINGS

A more complete understanding of the present invention may be had by reference to the following Detailed Description, when taken in conjunction with the accompanying drawing, wherein.

DETAILED DESCRIPTION OF THE PREFERRED EMBODIMENT

Figure 1:
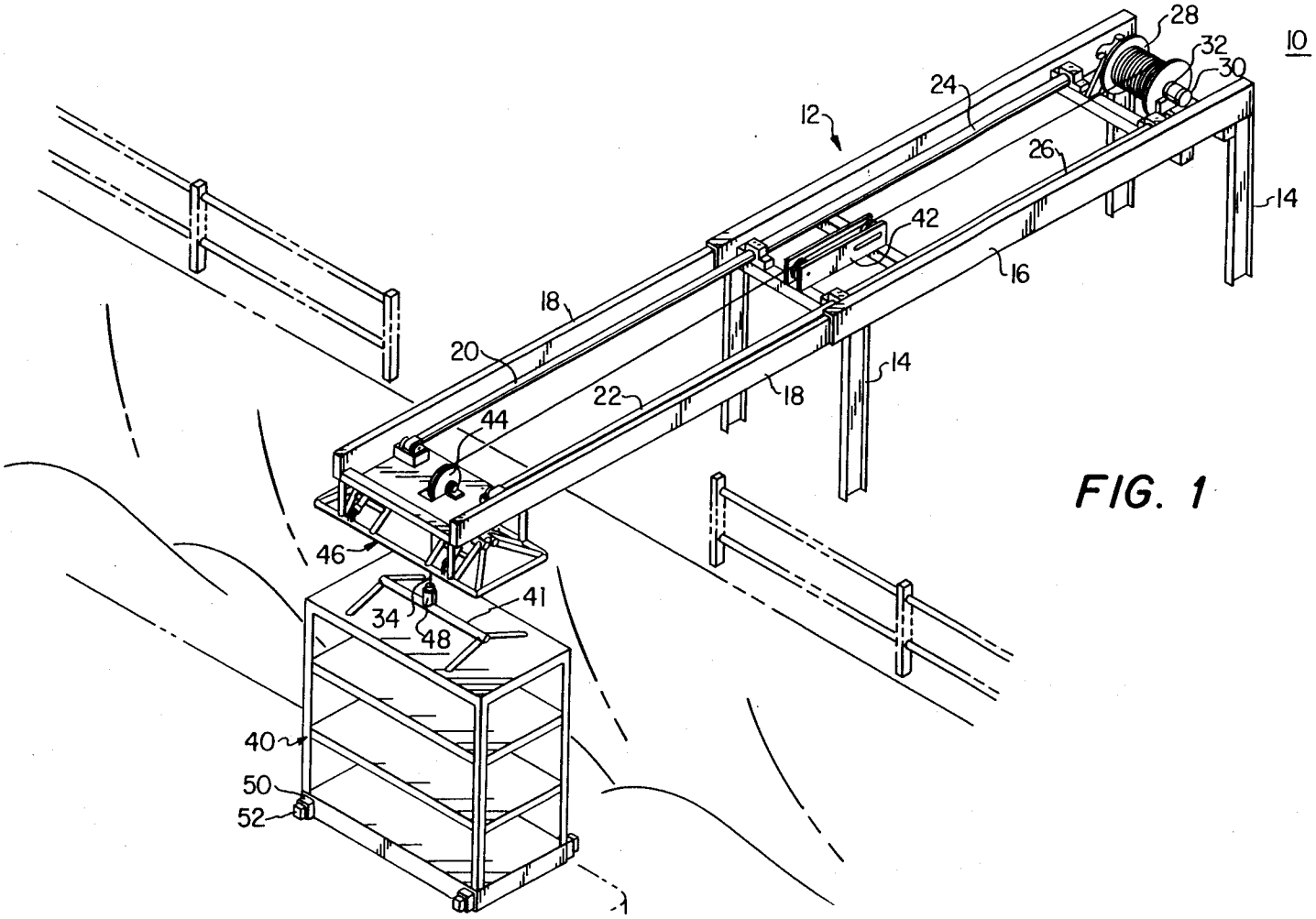
FIG. 1 is a perspective view of the hoisting device.

Referring now to the drawings, wherein like reference numerals designate like or corresponding parts throughout, FIG. 1 illustrates a litter transport system 10 incorporating the present invention. Transport system 10 comprises a retractable boom 12 which is secured by support members 14 to the main frame of a hospital ship. Boom 12 includes a stationary member 16 and a telescoping member 18 slidably engaged in stationary member 16. Telescoping member 18 is extended or retracted in stationary member 16 under the control of an open loop hydraulic system including hydraulic cylinders 24 and 26 located on stationary member 16.

A hoist unit 28 is secured to member 16 and includes a position encoder 30 and slip rings 32. Slip rings 32 are of conventional design of the type commercially available and are provided to couple hoist unit 28 to the control system components as described hereinafter with respect to FIG. 2. Position encoder 30 is a rotary transducer of conventional design and is operable to determine the position and velocity of the litter carrier relative to the hospital ship. Hoist 28 controls the movement of a hoist line 34. Hoist line 34 includes internal electrical conductors and extends between hoist 28 and a litter carrier 40. When thus extended, hoist line 34 passes through a motion compensating shock absorber 42 mounted on boom 12. Shock absorber 42 is of conventional design and comprises a hydraulic cylinder fitted with a position transducer 62 (FIG. 2) and connected through control valves (not shown) to a hydraulic accumulator (not shown). Hoist line 34 is then extended over a pulley 44 and through a latch 46 mounted at the end of telescoping member 18 to a carrier latch 48 positioned at the top of litter carrier 40. Carrier 40 includes acoustic rangefinders 50 and contact detectors 52 which are mounted on the bottom of the carrier at each corner. The internal conductors of hoist line 34 electrically connect acoustic rangefinders 50 and contact detectors 52 with a control circuit 60 (FIG. 2) through slip rings 32 of hoist unit 28.

Figure 2:
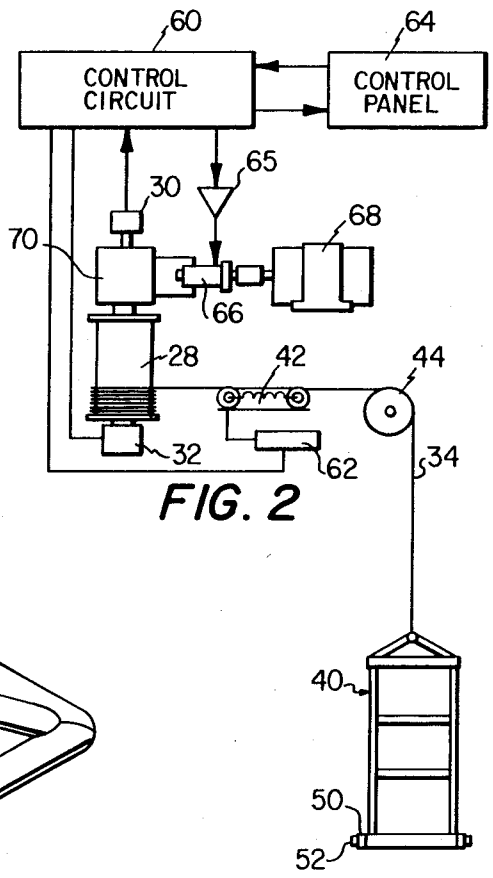
FIG. 2 is a schematic diagram of the operating elements of the system.

FIG. 2 is an schematic diagram of the litter transport system of the present invention. As shown in FIG. 2, the internal conductors of hoist line 34 are electrically connected to control circuit 60 located onboard the hospital ship. Control circuit 60 is also coupled to and receives an input from position transducer 62 and from an operator control panel 64. Control panel 64 includes controls for controlling the movement of telescoping member 18 between an extended or retracted position and for controlling the raising or lowering of carrier 40. Switches and corresponding indicators are also provided on control panel 64 for activating and deactivating the system and for locking and unlocking latch 46 (FIG. 1).

In operation, control panel 64 provides an output signal to control circuit 60 which is processed with inputs from rangefinders 50, contact detectors 52 and position transducer 62 to provide a control signal to an amplifier 65. The amplified control signal is applied to a hydraulic pump 66 which is driven by an electric motor 68. Hydraulic pump 66 drives a hydraulic motor 70 which in turn controls hoist 28 to effect the transfer of carrier 40.

Figure 3:
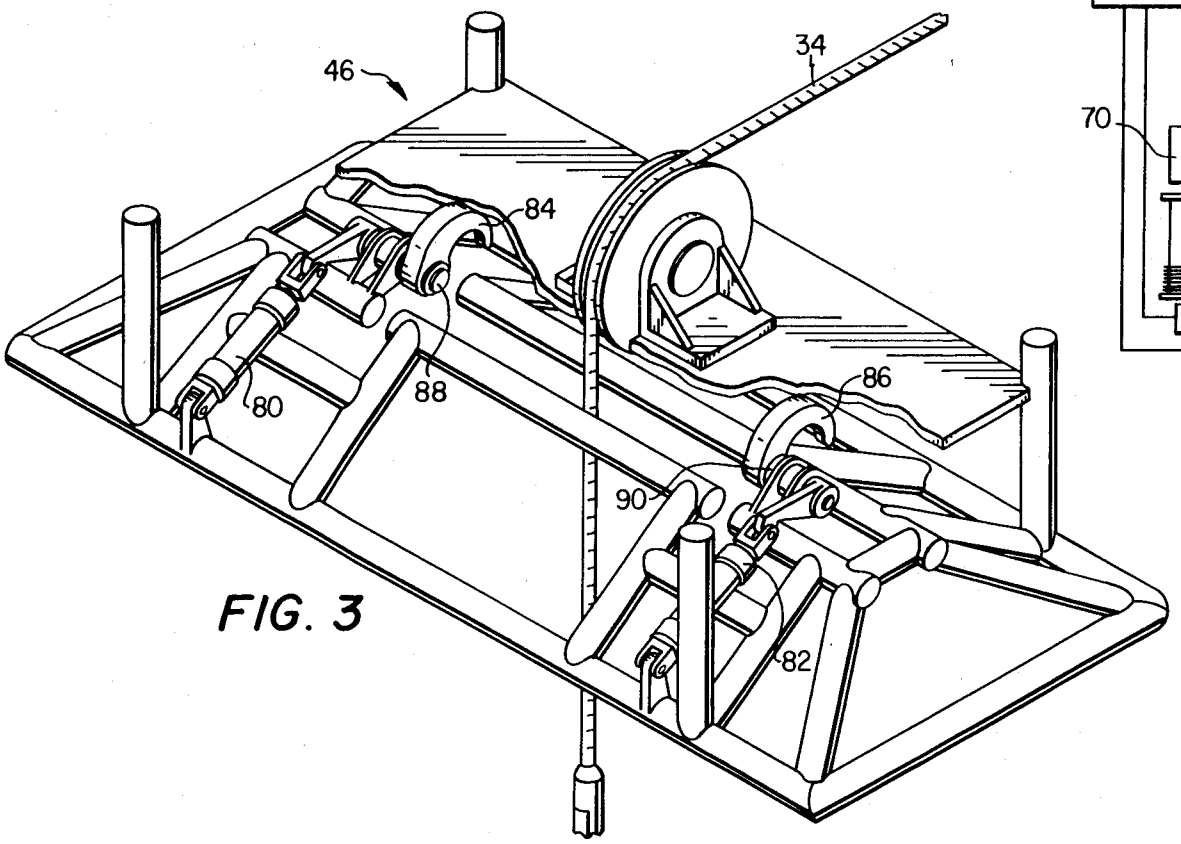
FIG. 3 is a sectional view of the latch shown in FIG. 1.

Latching device 46 of FIG. 1 is shown in greater detail in FIG. 3. The latch includes a pair of hydraulic cylinders 80 and 82 having operatively associated therewith a pair of hook members 84 and 86. When activated, cylinders 80, 82 are operative to cause hook members 84, 86 to pivot about points 88 and 90 respectively. As best shown in FIG. 1, carrier 40 includes a rod-shaped member 41 mounted on the top surface thereof. As the carrier is moved toward the hospital ship, hook members 84, 86 are operated to engage member 41 to thus lock the carrier in place at the end of telescoping member 18.

In operation, when it is desired to transfer patients to a hospital ship from a transport ship using the litter transport system, the operator first activiates the system by depressing a power switch on control panel 64. Telescoping member 18 is then extended using the extend-/retract controls on control panel 64 to thus also extend and position carrier 40 out over the transport vessel. Hydraulic cylinders 80, 82 are then operated to unlock latch 46 and thus permit carrier 40 to be lowered toward the deck of the transport vessel. As carrier 40 is positioned above the transport vessel, acoustic rangefinders 50 provide a feedback signal to control circuit 60 to indicate the altitude of the carrier relative to the transport vessel. That signal when received by control circuit 60 is operable to vary the rate of descent of carrier 40 to minimize the risk of an abrupt landing on the transport vessel. This automatic feedback control continues until carrier 40 has landed aboard the transport vessel. Once the carrier contacts the deck of the vessel, contact detectors 52 provide a feedback signal to control circuit 60 to indicate that the carrier has landed. The feedback signal is processed through control circuit 60 to place the transport system into a "constant tension" mode. In that mode the carrier is released from direct operator control and control circuit 64 is operative to vary the extent of hoist line displacement to compensate for the relative movement of the two ships so that constant tension is maintained on hoist line 34. One or more litters are then placed on carrier 40 for transport to the hospital ship. Before the carrier contacts the deck, the control valve coupling the hydraulic cylinder of shock absorber 42 and hydraulic accumulator will have been kept closed thus causing the shock absorber 42 to hold a fixed position. Once the carrier lands, the control valve is opened causing shock absorber 42 to thereafter act as a spring to prevent the hoist line from going slack. Position transducer 62 is operable to provide a signal to control circuit 60 representative of the position of the shock absorber so that if the shock absorber is getting too near either end of its stroke, e.g., as a result of boat motion, control circuit 60 will operate hoist 28 to adjust the amount of hoist line extension, to thus recenter shock absorber 42. During this "constant tension" mode, position transducer 62 and position encoder 30 repetitively measure the hoist line displacement changes which will vary with the relative motion between the transport and hospital ships. Each of those displacement signals is then stored in control circuit 60. Once the litters have been loaded onto carrier 40, the operator will activate the appropriate control panel switch to raise carrier 40. Control circuit 60 is operative, upon receipt of the lift-off signal while in the constant tension mode, to delay the raising of carrier 40 until the transport vessel has reached a peak in its upward movement, i.e., when the hoist line displacement is at a minimum, to thus ensure against the transport vessel crashing into the carrier after lift-off. During the constant tension mode, as the carrier is rising and falling with the motion of the transport vessel, position transducer 62 and position encoder 30 detect the amount of hoist line extension as it varies from a minimum, when the transport vessel is at a peak relative to the boom, to a maximum amount of hoist line displacement, when the transport vessel is at its lowest point relative the boom. This memory feature thus allows carrier 40 to be lifted from the transport vessel when the transport vessel is at or near one of its previously recorded peaks. After liftoff, acoustic rangefinders 50 are operative to sense the relative motion of carrier 40 and the transport vessel and to signal control circuit 60 to vary the rate of ascent of carrier 40 to avoid a collision. After liftoff, carrier 40 is raised to its topmost position and carrier latch 48 engages with latch 46 to lock the carrier in place at the end of telescoping member 18. Once carrier 40 has been locked in place, the operator retracts telescoping member 18 to bring carrier 40 over the deck of the hospital ship for unloading. When carrier 40 is positioned over the hospital ship, hydraulic cylinders 80, 82 are operated to unlock latch 46 and thereby release carrier 40. The operator then operates the control panel switch to lower carrier 40 onto the deck of the hospital ship. As carrier 40 is landed onboard the deck of the hospital ship, the acoustic rangefinders and contact detectors operate as described above to assure a smooth landing.

The transport system described herein includes a plurality of rangefinders and contact detectors to assure accurate readings. The control circuit 60 thus includes means for comparing the output of the rangefinders and contact detectors and disregarding spurious signals which may be generated by a defective sensor. The use of a plurality of sensors also provides a means to detect the tilt and/or sway of the carrier 40. It should be noted, however, that the present invention may be practiced using only one rangefinder and/or one contact detector. It should also be noted that the rangefinder and contact detector signals may be transmitted to the control circuit 60 by means including electromagnetic transmission in addition to the hardwire option shown in the preferred embodiment.

The present invention has been described in terms of a hospital ship litter transport system, but it is understood that this is only one application of the preferred embodiment and the invention may also be applied to any situation where fragile cargo needs to be transferred from one location to another especially in situations where there is relative movement between the locations. A system consisting of three or more hoists using these control systems would be capable of controlling the attitude as well as the altitude of the load being transferred. This would allow large loads to be transferred between vessels, as the load could be controlled to land parallel to the deck of the transfer vessel.

In summary, an improved cargo transport system includes a control circuit and an operator-controlled hoist device. Motion compensation circuitry is also included and is operable to vary the movement of the transport carrier to compensate for relative motion between the pick-up and delivery locations.

What is claimed is:

1. A transport system for transferring cargo between a first location and a second location comprising:

hoisting means located at the first location;

a hoist line having one end thereof connected to said hoisting means;

a carrier device connected to the other end of said hoist line;

operator control means for generating operator command signals;

shock absorbing means for providing a relatively constant tension on said hoist line, said shock absorbing means having variable stroke positions and having a maximum and a minimum stroke position, and said shock absorbing means being operable to change its stroke position in response to a change in tension on said hoist line;

stroke measuring means for measuring the stroke position of said shock absorbing means, said stroke measuring means being operable to transmit stroke position signals;

control means connected to said operator control means, said stroke measuring means and said hoisting means, said control means being operable in response to operator command signals and stroke positions signals to generate control signals to operate said hoisting means to cause movement of said hoist line; and means for measuring said movement of said hoist line caused by said hoisting means and for generating line movement signals to said control means, said control means generating control signals to operate said hoisting means to cause upward movement of said carrier device based on said stroke position signals and said line movement signals.

2. The transport system of claim 1 wherein said hoisting means includes a stationary boom member and a telescoping boom member slidably engaged therewith, said hoisting means further including a hoist unit mounted on said stationary boom member, and wherein said transport system further comprises a first hydraulic means connected to said control means and operable in response to control signals to extend said telescoping boom member relative to said stationary boom member.

3. The transport system of claim 1, further comprising distance measuring means attached to said carrier device for measuring the distance between said carrier device and a selected one of said locations, said distance measuring means being operable to generate a distance-related signal; and means for transmitting the distance-related signal to said control means, said control means being operable in response to the distance-related signal to modify the control signals in accordance therewith.

4. The transport system of claim 3 wherein said distance meausring means comprises an acoustic sensor and said hoist line includes a cable mechanically connected to said carrier device and electrical conductors located within said cable for electrically connecting said acoustic sensor with said control means.

5. The transport system of claim 4 wherein said carrier device includes a contact detector connected to said electrical conductors, said contact detector being operable to provide a contact signal when said carrier device contacts one of said locations, said control means being operable in response to the contact signal to modify the control signals in accordance therewith.

6. The transport system of claim 1 wherein said shock absorbing means is operable only when said carrier means is in a landed position.

7. The transport system of claim 1 wherein said control means generates control signals to operate said hoisting means to cause movement of said hoist line in response to stroke position signals indicating that said shock absorbing means in near either said minimum or maximum stroke positions, in order to return said shock absorbing means to a center position.

8. The transport system of claim 1, wherein said control means stores said stroke position signals and said line movement signals generated while said carrier's located on the second location in order to determine a proper time to lift said carrier device from said second location.

9. A transport system for transferring cargo between a first location and a second location comprising:

hoisting means located at the first location;

a hoist line having one end thereof connected to said hoisting means;

a carrier device connected to the other end of said hoist line;

operator control means for generating operator command signals;

control means connected to said operator control means and said hoisting means, said control means being operable in response to operator command signals to generate control signals, said hoisting means being responsive to said control signals to effectuate movement of said carrier device between said first and second locations;

tension means operatively coupled to said hoist line, said tension means being operable to maintain said hoist line at a constant tension independently of said hoisting means over a predetermined range when said carrier is in a landed position at one of said locations;

encoder means operable to detect movement of said hoisting means and said tension means in order to determine the extent of hoist line extension when said carrier is landed and to provide a line signal to said control means representative of hoist line extension resulting from the relative movement of said first and second locations, said control means being operable to store the values of said line signals, said control means being further operable in response to a operator command signal to raise said carrier to delay execution of said command until a line signal is received at said control means from said encoder means that is less than or equal to each of said stored values.

10. The transport system of claim 9, and further including distance measuring means attached to said carrier device for measuring the distance between said carrier device and a selected one of said locations, said distance measuring means being operable to provide a distance related signal; and means for transmitting said distance related signals to said control means, said control means being operable in response to the distance related signal to modify the control signals in accordance therewith.

11. The transport system of claim 10 wherein said hoisting means includes a stationary boom member and a telescoping boom member slidably engaged in said stationary boom member, said hoisting means further including a hoist unit mounted on said stationary boom member, the transport system further including a first hydraulic means connected to said control means and operable in response to control signals to extend said telescoping boom member relative to said stationary boom member.

12. The transport system of claim 10 wherein said distance measuring means comprises a plurality of acoustic sensors.

13. The transport system of claim 12 wherein said hoist line includes a cable mechanically connected to said carrier device and electrical conductors located within said cable for electrically connecting said plurality of acoustic sensors with said control means.

14. The transport system of claim 9 wherein said distance measuring means comprises an acoustic sensor.

15. The transport system of claim 14 wherein said hoist line includes a cable mechanically connected to said carrier device and electrical conductors located within said cable for electrically connecting said acoustic sensor with said control means.

16. The transport system of claim 15 wherein said carrier device also includes a contact detector connected to said electrical conductors, said contact detector being operable to provide a contact signal when said carrier device contacts one of said locations, said control means being operable in response to the contact signal to modify the control signals in accordance therewith.

17. The transport system of claim 9, wherein said tension means is a shock absorber which expands and contracts in response to line tension changes.

18. The transport system of claim 17 wherein said hoist line operates to center the stroke of said shock absorber in response to a signal indicating that said shock absorber is near the beginning or the end of its stroke.

19. A transport system for transferring cargo between a first location and a second location comprising:

hoisting means;

a hoist line having one end thereof connected to said hoisting means;

a carrier device connected to the other end of said hoist line, said carrier device comprising:

a housing for carrying cargo; and a locking device located on the top of said housing, said locking device being arranged for connection to the hoisting mechanism;

latching means mounted on said hoisting means and selectively operative to engage said locking device of said carrier device to thus secure said carrier device to said hoisting means independent of said hoist line;

operator control means for generating command signals; and shock absorbing means for providing a relatively constant tension on said hoist line, said shock absorbing means having variable stroke positions and having a maximum and a minimum stroke position, said shock absorbing means being operable to change its stroke position in response to a change in tension on said hoist line;

stroke measuring means for measuring the stroke position of said stroke measuring means, said stroke measuring means being operable to transmit stroke position signals;

control means connected to said operator control means, said stroke means and said hoisting means, said control means being operable in response to operator control signals and stroke position signals to generate control signals to operate said hoisting means to cause movement of said hoist line; and means for measuring said movement of said hoist line caused by said hoisting means and for generating line movement signals to said control means, said control means generating control signals to operate said hoisting means to cause upward movement of said carrier device based on said stroke position signals and said line movement signals.

20. The transport system of claim 19, and further including distance measuring means attached to said carrier device for measuring the distance between said carrier device and a selected one of said locations, said distance measuring means being operable to provide a distance related signal;

means for transmitting said distance related signals to said control means, said control means being operable in response to the distance related signal to modify the control signals in accordance therewith.

21. The transport system of claim 20, wherein said hoisting means includes a stationary boom member and a telescoping boom member slidably engaged therewith, said hoisting means further including a hoist unit mounted on said stationary boom member, and wherein said transport system further comprises a first hydraulic means connected to said control means and operable in response to control signals to extend said telescoping boom member relative to said stationary boom member.

22. The transport system of claim 20, wherein said distance measuring means comprises an acoustic sensor.

23. The transport system of claim 22, wherein said hoist line includes a cable mechanically connected to said carrier device and electrical conductors located within said cable for electrically connecting said acoustic sensor with said control means.

24. The transport system of claim 23, wherein said carrier device includes a contact detector connected to said electrical conductors, said contact detector being operable to provide a contact signal when said carrier device contacts one of said locations, said control means being operable in response to the contact signal to modify the control signals in accordance therewith.

25. The transport system of claim 20, wherein said distance measuring means comprises a plurality of acoustic sensors.

26. The transport system of claim 25, wherein said hoist line includes a cable mechanically connected to said carrier device and electrical conductors located within said cable electrically connecting said acoustic sensors with said control means.

27. The transport system of claim 26, wherein said carrier device includes a plurality of contact sensors connected to said electrical conductors, said contact sensors being operable to provide a contact signal when any of said contact detectors contacts one of said locations, said control means being operable in response to the contact signals to modify the control signals in accordance therewith.

* * * * *

UNITED STATES PATENT AND TRADEMARK OFFICE

CERTIFICATE OF CORRECTION

PATENT NO. : 4,666,357

DATED : May 9, 1987

INVENTOR(S) : Harvey Babb

It is certified that error appears in the above-identified patent and that said Letters Patent is hereby corrected as shown below:

[75] change "Babbi" to --Babb--

Column 5, line 54, change "meausring" to --measuring--

Signed and Sealed this

Fifteenth Day of September, 1987

*Attest:*

DONALD J. QUIGG

*Attesting Officer*

*Commissioner of Patents and Trademarks*